US010389064B2

(12) United States Patent
Mito

(10) Patent No.: US 10,389,064 B2
(45) **Date of Patent: *Aug. 20, 2019**

(54) CONNECTOR AND CONNECTOR ASSEMBLY

(71) Applicant: Tyco Electronics Japan G.K., Kanagawa (JP)

(72) Inventor: Yusuke Mito, Kanagawa-ken (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,449

(22) Filed: May 24, 2018

(65) Prior Publication Data

US 2018/0269626 A1 Sep. 20, 2018

Related U.S. Application Data

(63) Continuation of application No. 15/615,241, filed on Jun. 6, 2017, now Pat. No. 10,014,628.

(30) Foreign Application Priority Data

Jun. 7, 2016 (JP) ..... 2016-113531

(51) Int. Cl.
*H01R 13/64* (2006.01)
*H01R 13/629* (2006.01)
(Continued)

(52) U.S. Cl.
CPC ..... *H01R 13/62977* (2013.01); *H01R 13/26* (2013.01); *H01R 13/40* (2013.01);
(Continued)

(58) Field of Classification Search
CPC ..... H01R 13/4361; H01R 13/639
(Continued)

(56) References Cited

U.S. PATENT DOCUMENTS 5,871,363 A 2/1999 Kimura
6,077,097 A 6/2000 Kumakura et al.
(Continued)

FOREIGN PATENT DOCUMENTS

EP 2369691 A1 9/2011
JP 200123724 A 1/2001
(Continued)

OTHER PUBLICATIONS

French Search Report, Application No. FR 1754950, dated Apr. 8, 2019, 6 pages.

*Primary Examiner* — Phuong Dinh
(74) *Attorney, Agent, or Firm* — Barley Snyder

(57) ABSTRACT

A connector comprises a first housing, a cam member, and an operation lever. The first housing has a mating portion configured to mate with a second housing of a second connector. The cam member has a cam groove configured to mate with a cam pin provided on the second housing. The cam member causes the second housing to mate with the first housing by sliding in a lateral direction intersecting with a direction of mating to draw the cam pin into the cam groove. The operation lever slides the cam member according to a turning operation. A nipping portion of the connector nips the cam pin in the cam groove when the cam member slides up to a mating completion position at which mating of the second housing with the first housing is completed.

16 Claims, 16 Drawing Sheets

(51) Int. Cl.
*H01R 13/26* (2006.01)
*H01R 13/40* (2006.01)
*H01R 13/453* (2006.01)

(52) U.S. Cl.
CPC ... *H01R 13/4538* (2013.01); *H01R 13/62905* (2013.01); *H01R 13/62922* (2013.01); *H01R 13/62944* (2013.01)

(58) Field of Classification Search
USPC ..... 439/157, 347
See application file for complete search history.

(56) References Cited

U.S. PATENT DOCUMENTS

| | | | | |
|---|---|---|---|---|
| 2008/0020613 | A1 | 1/2008 | Matsuura et al. | |
| 2008/0102668 | A1 | 5/2008 | Ikeya et al. | |
| 2014/0127921 | A1 | 5/2014 | Shimizu et al. | |
| 2017/0352982 | A1* | 12/2017 | Mito ..... | H01R 13/26 |

FOREIGN PATENT DOCUMENTS

| | | | |
|---|---|---|---|
| JP | 201326154 | A | 2/2013 |
| JP | 201499267 | A | 5/2014 |

* cited by examiner

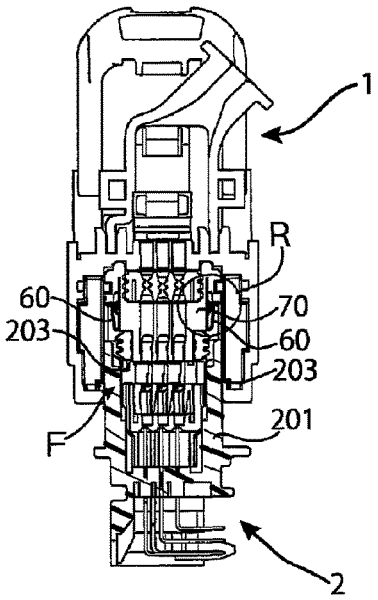
Fig. 11 (A－1)
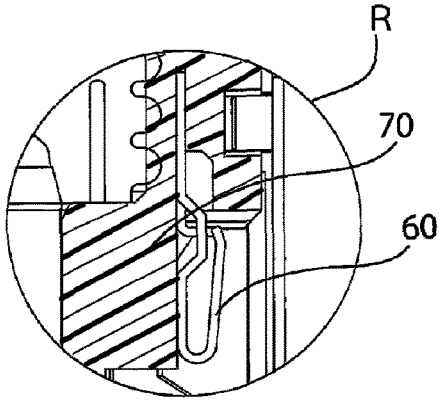
Fig. 11 (B－1)
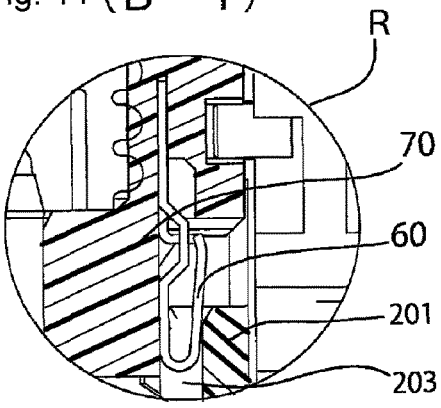
Fig. 11 (B－2)
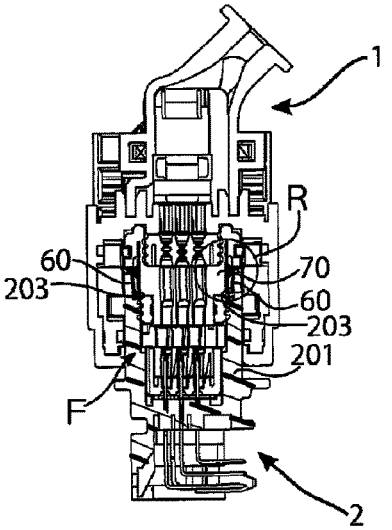
Fig. 11 (A－3)
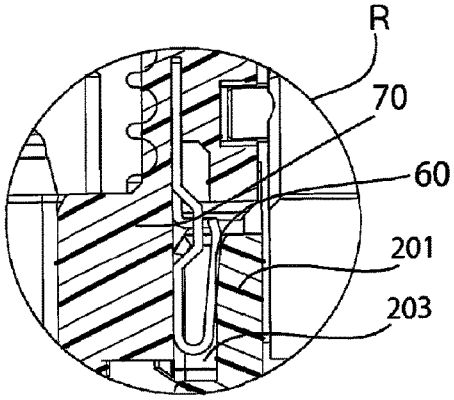
Fig. 11 (B－3)

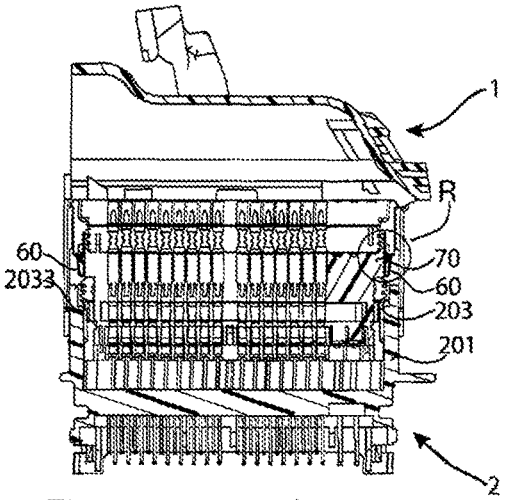
Fig. 12 (A－1)
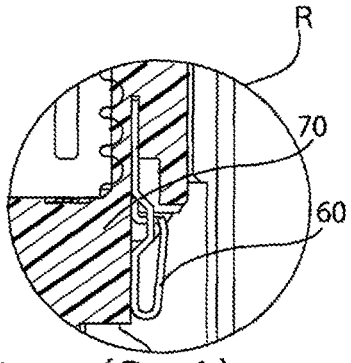
Fig. 12 (B－1)
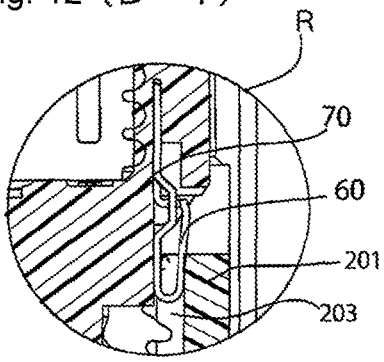
Fig. 12 (B－2)
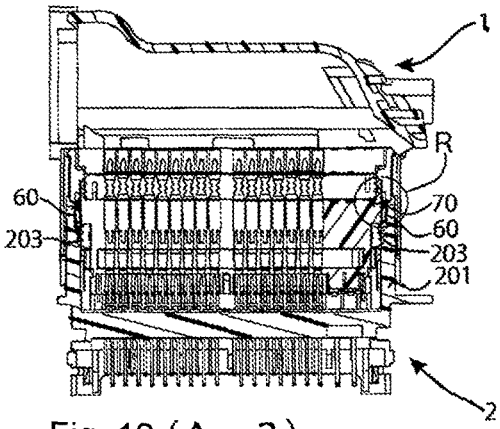
Fig. 12 (A－3)
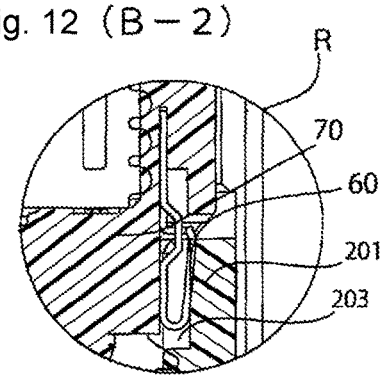
Fig. 12 (B－3)

CONNECTOR AND CONNECTOR ASSEMBLY

CROSS-REFERENCE TO RELATED APPLICATIONS

This application is a continuation of U.S. patent application Ser. No. 15/615,241, filed Jun. 6, 2017, which claims the benefit of the filing date under 35 U.S.C. § 119(a)-(d) of Japanese Patent Application No. 2016-113531, filed Jun. 7, 2016.

FIELD OF THE INVENTION

The present invention relates to a connector and a connector assembly having a structure for preventing rattling between housings from occurring.

BACKGROUND

A connector provided with an operation lever for reducing a force required for mating performed by an operator when connectors are caused to mate with each other is known. For example, in JP2014-99267A, a connector assembly composed of a connector provided with a slider and an operation lever for sliding the slider and a mating connector having a cam pin is disclosed.

There is a problem when a connector assembly is arranged at a location to which vibrations are transmitted, such as in the vicinity of an engine of an automobile. In such a case, when rattling occurs between housings, the contact portion of a contact is rubbed and shaved, which may result in contact failure. Therefore, a connector assembly arranged at the location to which vibrations are transmitted must have a structure for preventing rattling between the housings from occurring.

A connector assembly having a slider is positioned at the location to which vibrations are transmitted. There is play between the slider and the housing because the slider must be slid to the housing. Further, since the slider must move the cam pin of the mating connector within a cam groove, there is also play between the cam groove and the cam pin. Therefore, in the case of the connector assembly provided with the above-described cam member, rattling occurs between the housings and between each housing and the cam member.

SUMMARY

A connector comprises a first housing, a cam member, and an operation lever. The first housing has a mating portion configured to mate with a second housing of a second connector. The cam member has a cam groove configured to mate with a cam pin provided on the second housing. The cam member causes the second housing to mate with the first housing by sliding in a lateral direction intersecting with a direction of mating to draw the cam pin into the cam groove. The operation lever slides the cam member according to a turning operation. A nipping portion of the connector nips the cam pin in the cam groove when the cam member slides up to a mating completion position at which mating of the second housing with the first housing is completed.

BRIEF DESCRIPTION OF THE DRAWINGS

FIGS. 11(A-1) and 11(A-3) are cross-sectional views of the connector assembly taken along line E-E of FIG. 9(A) and FIGS. 11(B-1), 11(B-2), and 11(B-3) are cross-sectional views, on an enlarged scale, of portions of the cross-sectional views taken along line E-E of FIG. 9(A);

FIGS. 12(A-1) and 12(A-3) are cross-sectional views of the connector assembly taken along line C-C of FIG. 9(A) and FIGS. 12(B-1), 12(B-2), and 12(B-3) are cross-sectional views, on an enlarged scale, of portions of the cross-sectional views taken along line C-C of FIG. 9(A);

DETAILED DESCRIPTION OF THE EMBODIMENT(S)

Figure 1:
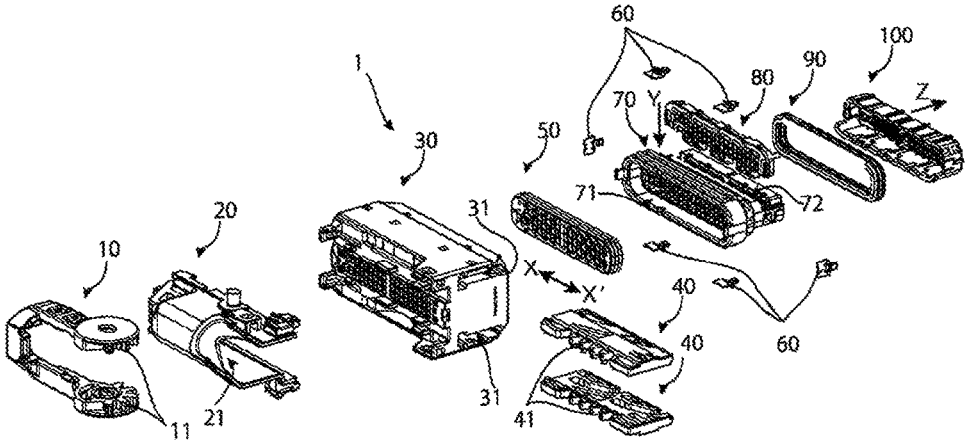
FIG. 1 is an exploded perspective view of a first embodiment of a connector constructed in accordance with the present invention.
Figure 9A:
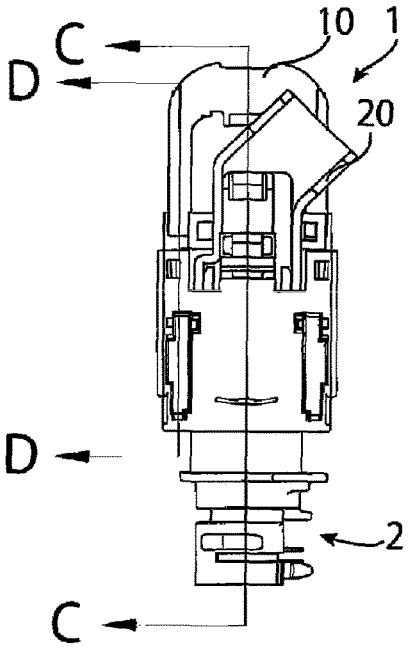
FIG. 9(A) is a side view of a connector assembly composed of the first connector and a second connector and FIG. 9(B) is a cross-sectional view of the connector assembly taken along line C-C of FIG. 9(A)
Figure 9:
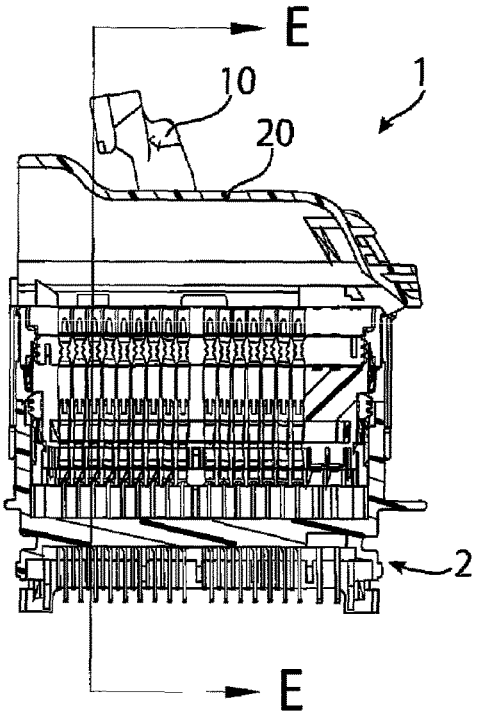

The connector shown in FIG. 1 is referred to as first connector 1 and a mating connector, configured to mate with the first connector 1, is referred to as second connector 2 shown in FIG. 9. A connector assembly is composed of the first connector 1 and the second connector 2.

Many terminals connected to ends of electric wires can be plugged into the connector 1 shown in FIG. 1 but are not shown in FIG. 1.

The first connector 1 shown in FIG. 1 has an operation lever 10. The operation lever 10 has pinion gears 11. The operation lever 10 slides cam members 40, described below, by a turning operation performed by an operator.

The first connector 1 has a wire cover 20. The wire cover 20 has an opening 21 through which many electric wires (not shown) connected with terminals at their ends pass.

The first connector 1 has a housing composed of an outer housing 30, an inner housing 70, and a front housing 100. The housing composed of the outer housing 30, the inner housing 70, and the front housing 100 is one example of the first housing in the present invention.

The outer housing 30 has two grooves connected to openings 31 opened to a side wall thereof and two plate-like cam members 40 are plugged into the respective grooves. These cam members 40 have racks 41. The racks 41 mesh with the pinion gears 11 of the operation lever 10, so that the cam members 40 slide in a lateral direction shown by arrow X-X' in FIG. 1 according to a turning operation of the operation lever 10.

The first connector 1 has two seal members 50 and 90. One seal member 50 has an opening 71 to the inner housing 70. The seal member 50 is in close contact with a surrounding wall of the opening 71 and surrounds electric wires (not shown) to closely contact the respective electric wires, thereby forming a sealing structure between the seal member 50 and the electric wires.

The other seal member 90 surrounds an outer periphery of the inner housing 70 and it serves as a seal between the inner housing 70 and the second connector 2 (see FIG. 9, FIG. 11, and FIG. 12) which has mated with the first connector 1.

The first connector 1 has a retainer 80. The retainer 80 is plugged into a groove 72 of the inner housing 70 opened in a lateral direction in a direction of arrow Y. The retainer 80 serves to securely locate and fix terminals (not shown) within the inner housing 70.

The first connector 1 has six spring members 60. The rear ends of the spring members 60 are press-fitted into the inner housing 70 to project in a direction of mating shown by arrow Z. A mating portion of the first connector 1, composed of the inner housing 70 and the like, is projected in the direction of mating (in the direction of arrow Z), has an approximately rectangular shape. Two of the six spring members 60 are press-fitted into two short sides of the approximately rectangular shape of the first connector 1 one by one. The remaining four spring members 60 are press-fitted into two long sides two by two. The spring members 60, two of which have been press-fitted into each of the long sides, are arranged such that the remaining two spring member 60 are press-fitted at positions, respectively, close to the short sides sandwiching the long side one by one. Functions of these spring member 60 will be described below.

Figure 2:
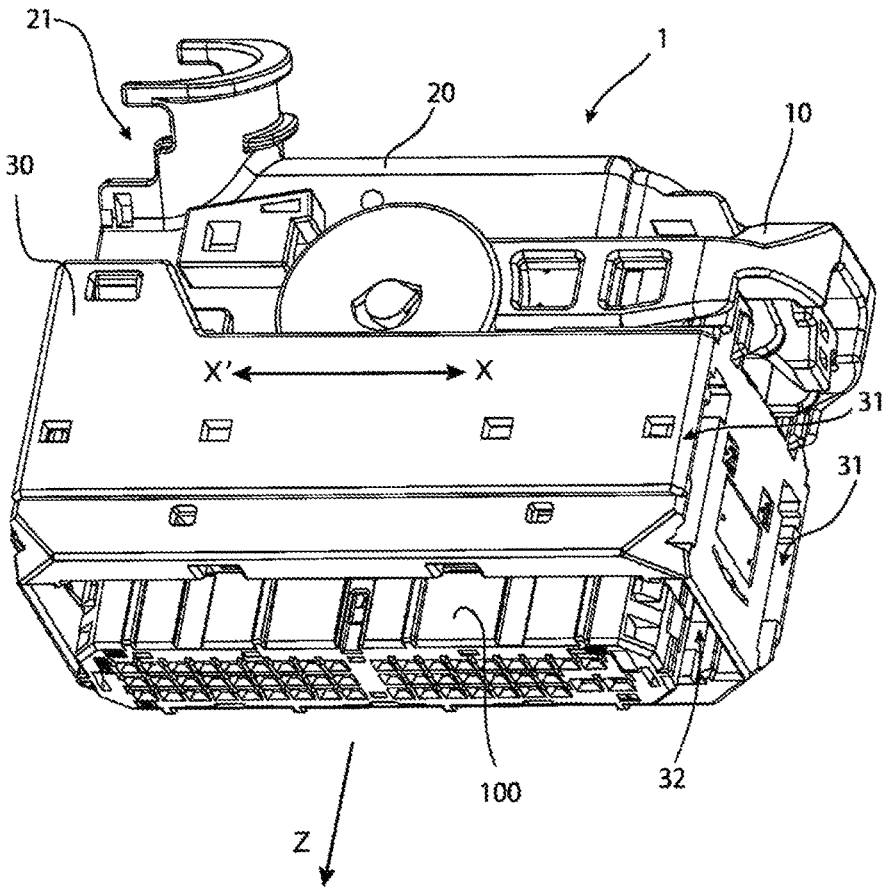
FIG. 2 is a perspective view of the FIG. 1 connector after assembly.

FIG. 2 is a perspective view showing a state where the first connector, shown with the exploded perspective view in FIG. 1, has been assembled. The outer housing 30 has a mating opening 32 opened in the direction of the mating (the direction shown by arrow Z). The inner housing 70 (see FIG. 1) and the front housing 100 are within the mating opening 32. The front housing 100 forms a space for the second connector mating around a full periphery between the same and the outer housing 30 to project from the mating opening 32.

In FIG. 2, though the second connector 2 is not shown, the operation lever 10 takes a posture where it has been turned up to a completely mating state of the second connector 2 in FIG. 2. When the operation lever 10 takes the posture shown in FIG. 2, the cam members 40 are in a state where the cam members 40 have been fully plugged into the grooves connected to the openings 31.

Figure 3:
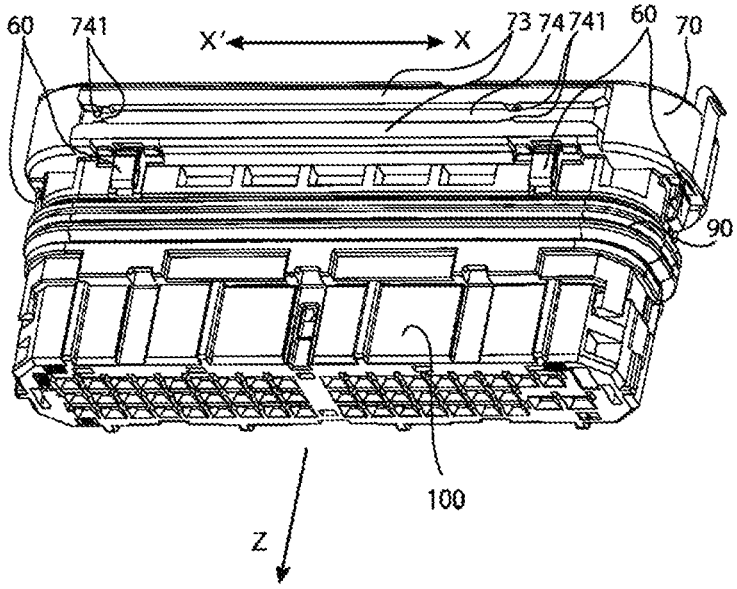
FIG. 3 is a perspective view showing a remaining portion of the assembly when a wire cover, an operation lever, and an outer housing have been detached from the first connector shown in FIG. 2.

FIG. 3 is a perspective view showing the remaining portions of the assembly when the wire cover, the operation lever, and the outer housing have been detached from the first connector and are in an assembled state shown in FIG. 2.

In FIG. 3, the inner housing 70, the seal member 90, the front housing 100, and the spring members 60 appear. The spring members 60 are press-fitted into the inner housing 70 to project from the inner housing 70 in the direction of the mating (the direction of arrow Z). Here, the spring members 60 press-fitted into the left and right short sides one by one and two spring members 60 press-fitted into the positions of one long side close to the respective short sides are shown. Similarly, two spring members 60 have been also press-fitted into the long side opposed to the long side shown in FIG. 3.

Further, the inner housing 70 is formed with a long groove 74 located between the two rails 73 extending along the long side of the inner housing 70. The two rails 73 and the long groove 74 are also similarly formed on the long side (not shown in FIG. 3) opposed to the long side shown in FIG. 3. The long groove 74 corresponds to one example of the guide groove in the present invention.

Bosses 42, shown in FIGS. 4A and 4(B) of the cam member 40, enter the long groove 74. The cam portion 40 slides in a lateral direction shown by arrow X-X', while it is being guided by the long groove 74 in a state where the bosses 42 have entered the long groove 74. Here, the long groove 74 is formed with narrowing portions 741 formed in narrowed grooves at two portions on the both sides of the long groove 74. The narrowing portions 741 are one example of the second narrowing portion and the second terminal portion in the present invention. A function of the narrowing portion 741 will be described later.

FIG. 4(A) is a perspective view of a cam member and FIG. 4(B) is a top view of a cam member. The first connector 1 is provided with two cam members 40 as shown in FIG. 1. The cam member 40 shown in FIGS. 4(A) and 4(B) is one cam member 40 of these two cam members 40. The other cam member 40 has a shape mirror-symmetrical to the cam member 40 shown in FIGS. 4(A) and 4(B). The cam member 40 has a rack 41. The rack 41 meshes with the pinon gear 11 of the operation lever 10 shown in FIG. 1 and the pinon gear 11 serves so as to slide the cam member 40 in the lateral direction (the direction of arrow X-X') according to a turning operation of the operation lever 10.

Further, the cam member 40 has six bosses 42 arranged in a lateral direction. These bosses 42 enter the long groove 74 shown in FIG. 3. The cam member 40 slides while being guided by the long groove 74. Here, the cam member 40 serves so as to draw the second connector 2 toward a completely mating state, as explained below. When the cam member 40 draws the second connector 2, it is subjected to a force from the second connector 2. The reason that six bosses 42 are formed on the cam member 40 is for providing a strength sufficient to receive the force from the second connector 2 to be mated.

In addition, the cam member 40 is formed with two cam grooves 43. Mating projections 202 (see FIGS. 10(A) to 10(C)) on a housing 201 (see FIG. 11(A-1) to 11(B-3) and FIG. 12(A-1)-12(B-3)) of the second connector 2 to be mated with the first connector 1 enter these cam grooves 43. The mating projection 202 is one example of the cam pin in the present invention.

When the cam members 40 slide in response to a turning operation of the operation lever 10, the mating projections 202 are drawn into the cam grooves 43. Thereby, the second connector 2 is drawn into the first connector 1 toward the completely mating state. When the mating projections 202 are drawn to the deepest positions of the cam grooves 43, the mating of the first connector 1 with the second connector 2 is completed. That is, the first connector 1 and the second connector 2 are put in the completely mating state. Here, the cam grooves 43 provided in the cam member 40 have narrowing portions 431 formed at the deepest portions thereof. The narrowing portions 431 are one example of the first nipping portion and the first terminal portion in the present invention. A function of the narrowing portions 431 will be described later.

FIG. 5(A) is a side view and FIG. 5(B) a top view of the first connector. In FIGS. 5(A) and 5(B), the operation lever 10 is in a raised posture and this is referred to as "mating start state". On the other hand, a state of the first connector 1 in a posture where the operation lever 10 is all the way down as shown in FIG. 2 is referred to as "completely mating state". A state of the first connector 1 in a posture where the operation lever 10 has been operated in a turning manner from the posture of the operation lever 10 shown in FIGS. 5A and 5(B) up to a halfway state toward the fallen-down posture shown in FIG. 2 is referred to as "mating halfway state".

Figure 5:
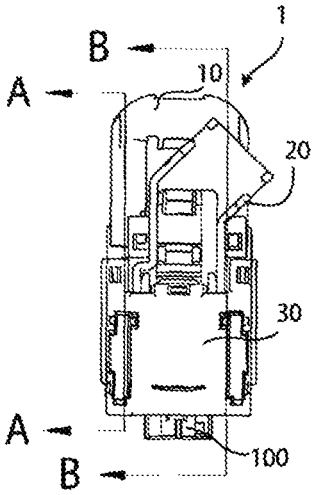
FIG. 5(A) is a side view of the first connector and FIG. 5(B) is a top view of the first connector.
Figure 5:
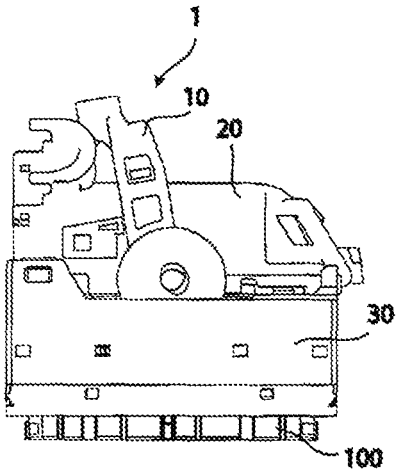
Figure 6:
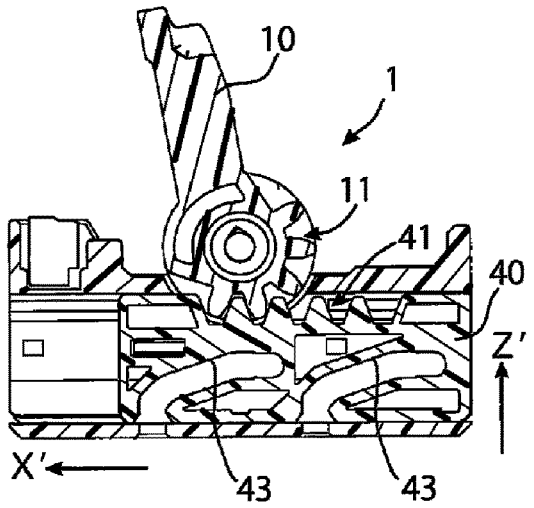
FIGS. 6(A), 6(B), and 6(C) are cross-sectional views taken along line A-A in FIG. 9(A) with the first connector in different states.
Figure 6:
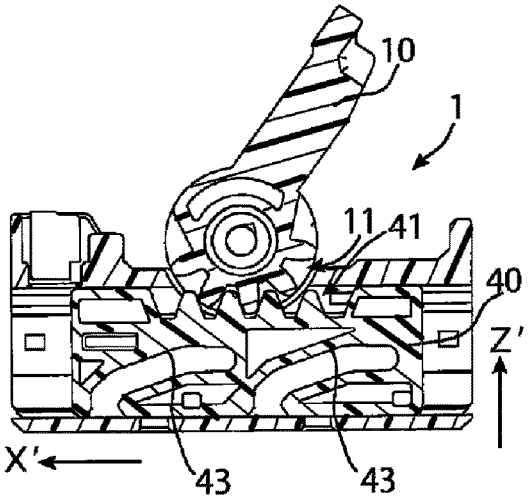
Figure 6:
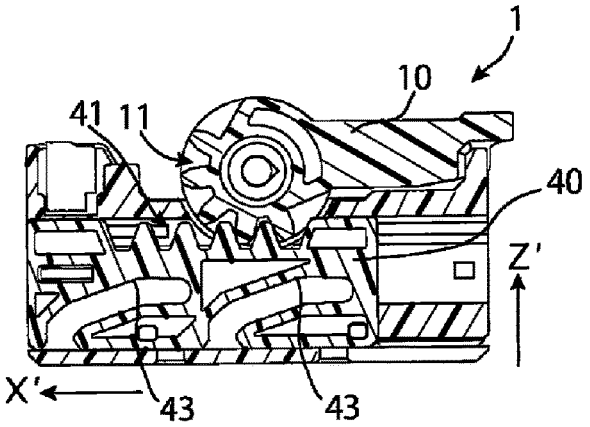
Figure 7:
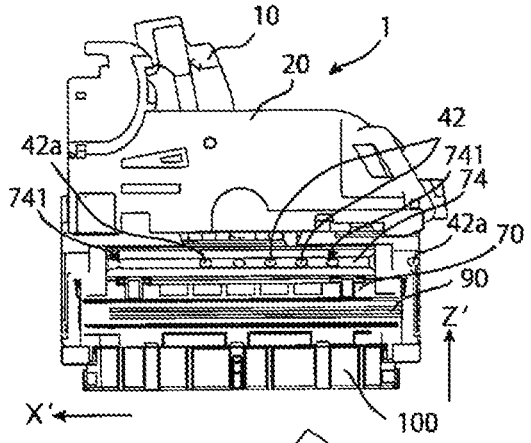
FIGS. 7(A), 7(B), and 7(C) are cross-sectional views taken along line B-B of FIG. 5A with the first connector in different states.
Figure 7:
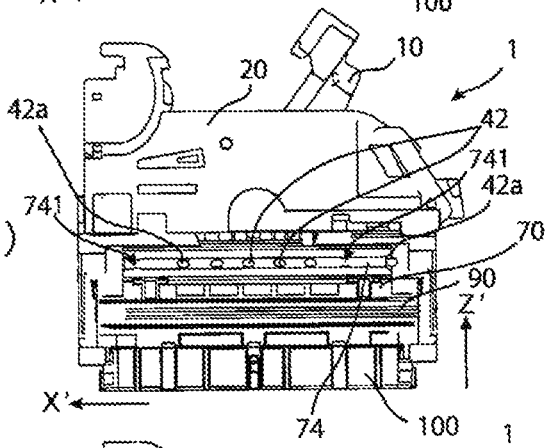
Figure 7:
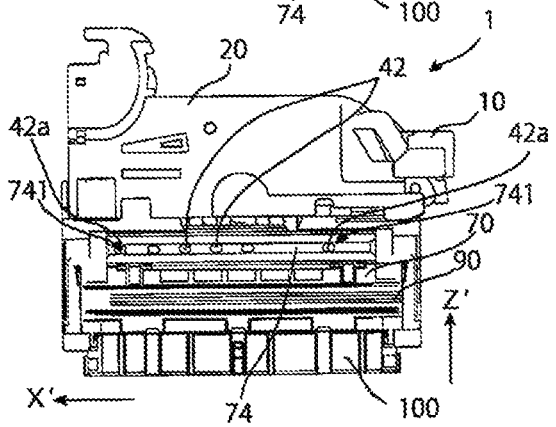

FIGS. 6(A), 6(B), and 6(C) are cross-sectional views of the first connector taken along line A-A shown in FIG. 5(A). FIGS. 5(A) and 5(B) show the connector 1 put in the "mating start state".

Therefore, a cross sectional view of the "mating start state" shown in FIG. 6(A) of the three cross-sectional views shown in FIGS. 6(A), 6(B), and 6(C) is a cross sectional view taken along arrow A-A shown in FIG. 5(A). FIGS. 6(B) and 6(C) are, respectively, the cross-sectional views of the "mating halfway state" and the "completely mating state" taken along line A-A in FIG. 5(A). This holds true for FIGS. 7(A), 7(B), and 7(C), FIGS. 10(A), 10(B), and 10(C), and FIGS. 14(A), 14(B), and 14(C). For example, such an abbreviated expression as "FIG. 6(A) is a cross-sectional view taken along line A-A in FIG. 5(A)" is adopted below without being specially noted.

As shown in FIGS. 6(A), 6(B), and 6(C), the pinion gear 11 of the operation lever 10 always meshes with the racks 41 of the cam members 40. The cam members 40 slide in the lateral direction (the direction of arrow X') to advance from the "mating start state" shown in FIG. 6(A) to the "mating halfway state" shown in FIG. 6(B), and further to the "completely mating state" shown in FIG. 6(C).

When the cam members 40 are located at the "mating start state" shown in FIG. 6(A), they are located at positions at which the cam members 40 receive the mating projections 202 of the second connector 2. The cam members 40 draw the mating projections 202 which the cam members 40 have received at the "mating start state" in the direction of arrow Z' to advance to the "mating halfway state" and further the "completely mating state".

FIGS. 7(A), 7(B), and 7(C) are cross-sectional views of the first connector taken along line B-B of FIG. 5(A). FIGS. 7(A), 7(B), and 7(C) show the "mating start state", the "mating halfway state", and the "completely mating state", respectively, like FIGS. 6(A), 6(B), and 6(C).

In FIGS. 7(A), 7(B), and 7(C), six bosses 42 on the cam member 40 are shown. These six bosses 42 move in the direction of arrow X' to advance from the "mating start state" to the "mating halfway state" and further the "completely mating state". At the "completely mating state" shown in FIG. 7(C), two bosses 42*a* of these six bosses 42 located at both ends are put in the narrowing portions 741 of the long grooves 74 in the inner housing 70. These bosses 42*a* at both the ends correspond to one example of the guide projections in the present invention.

Figure 8:
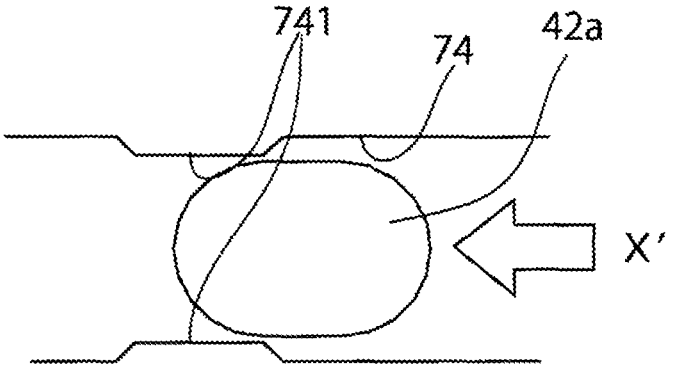
FIGS. 8(A) and 8(B) are schematic diagrams showing, respectively, before a boss of the cam member is nipped and after the boss of the cam member is nipped.
Figure 8:
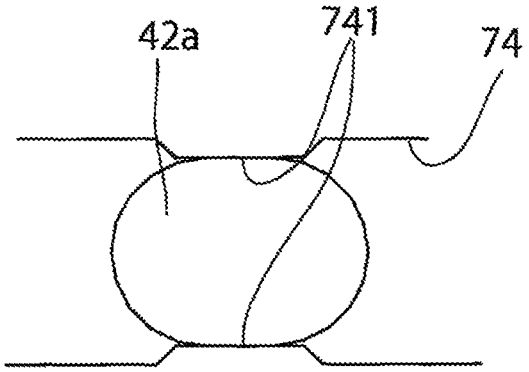

FIGS. 8(A) and 8(B) are schematic views showing an aspect where the boss of the cam member is nipped in the narrowing portion. Here, in FIG. 8(A), a state where the boss 42*a* is located just before nipped in the narrowing portion 741, is shown. Further, in FIG. 8(B), a state where the boss 42*a* has been nipped in the narrowing portion 741, is shown.

The cam member 40 slides up to the "completely mating state" in the direction of arrow X'. Thereby, as shown in FIG. 8B, two bosses 42*a* of six bosses 42 at both ends on the cam member 40 are put in a state where the two bosses 42*a* have been nipped in the narrowing portions 741 of the long grooves 74 in the inner housing 70. The narrowing portion 741 is set to have a width where the boss 42*a* is slightly press-fitted into the narrowing portion 741. When the boss 42*a* is press-fitted into the narrowing portion 741, the cam member 40 is integrated with the housing (the inner housing 70), so that rattling is prevented from occurring therebetween.

FIG. 9(A) is a side view of a connector assembly composed of a first connector and a second connector. FIG. 9(B) is a cross-sectional view of the connector assembly taken along line C-C of FIG. 9(A). In FIGS. 9(A) and 9(B), the first connector 1 is in the "mating start state" like FIG. 5, where the first connector and the second connector are in a temporarily engaged state.

Figure 10:
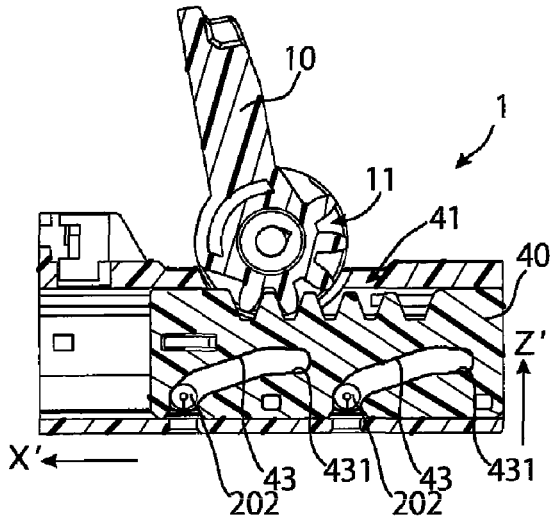
FIGS. 10(A), 10(B), and 10(C) are cross-sectional views taken along line D-D of FIG. 9A; with the connector assembly in different states.
Figure 10:
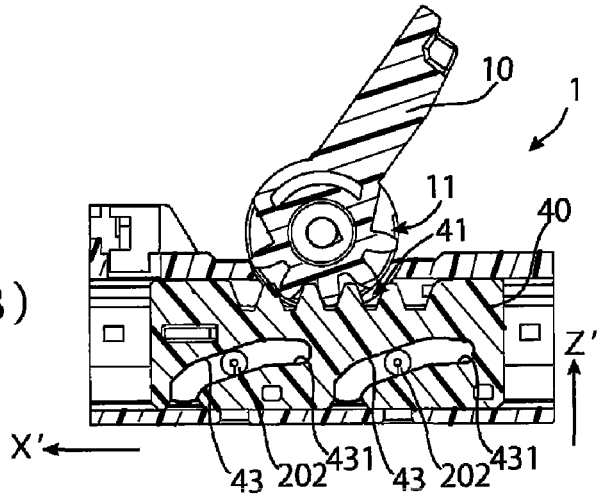
Figure 10:
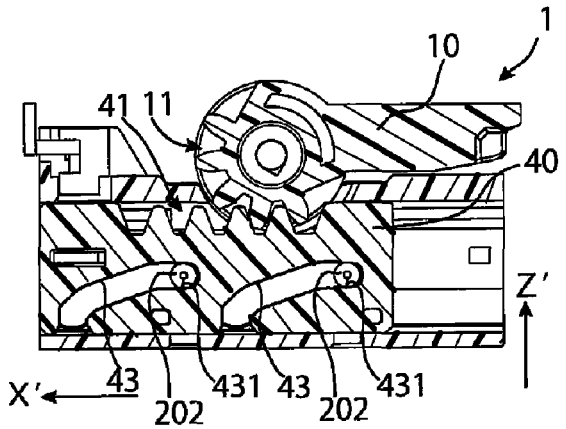

FIGS. 10(A), 10(B), and 10(C) are cross-sectional views taken along line D-D of FIG. 9(A). FIGS. 10(A), 10(B), and 10(C) show sections of the "mating start state", the "mating halfway state", and the "completely mating state", respectively. In FIGS. 10(A), 10(B), and 10(C), the mating projections 202 on the housing of the second connector 2 are shown 201 (see FIGS. 11(A-1), 11(A-3), 11(B-1), 11(B-2), 11(B-3), 12(A-1), 12(A-3), 12(B-1), 12(B-2), and 12)(B-3).

When the first connector 1 is put in the "mating start state" shown in FIG. 10(A), the second connector 2 is plugged to the first connector 1 up to the temporarily engaged state. Thereby, as shown in FIG. 10(A), the mating projections 202 of the second connector 2 enter entrance portions of the cam groove 43 of the cam member 40. Thereafter, the operation lever 10 is fallen down to advance to the "mating halfway state" (FIG. 10(B)) and further to the "completely mating state" (FIG. 10(C)). At this time, the cam member 40 slides in the direction of arrow X' to draw the mating projections 202 in the direction of arrow Z'. When the mating projection 202 shown in FIG. 10(C) is drawn up to the deepest positions of the cam grooves 43, the second connector 2 reaches the completely mating state with the first connector 1.

Here, the cam groove 43 has the narrowing portion 431 where the width of the cam groove 43 has been narrowed at a portion at which the mating projection 202 is located in the "completely mating state". The groove width of the narrowing portion 431 is such a width that the mating projection 202 is lightly press-fitted into the narrowing portion 431. Therefore, in the "completely mating state" shown in FIG. 10(C), the housing 201 of the second connector 2 is integrated with the cam member 40, so that rattling is prevented from occurring therebetween. In the "completely mating state", the bosses 42*a* at both the ends of the cam member 40 are nipped in the narrowing portions 741 of the long grooves 74 of the housing (the inner housing 70) of the first connector 1, as explained with reference to FIG. 7 and FIG. 8. Thus, in the "completely mating state", the first connector 1 and the second connector 2 are integrated with each other via the cam member 40 according to nipping of the mating projections 202 into the narrowing portions 431 and nipping of the boss portions 42*a* in the narrowing portions 741, so that rattling is prevented from occurring therebetween. The rattling prevention mechanism utilizing the cam member 40 is particularly effective in rattling prevention in the mating direction (the direction of arrow Z' or the direction of arrow Z in FIG. 1).

FIGS. 11(A-1) and 11(A-1) are cross-sectional views taken along line E-E of FIG. 9B. FIGS. 11(A-1) and 11(A-3) show the "mating start state" and the "completely mating state", respectively. Illustration of the "mating halfway state" is omitted to avoid complication in illustration. FIGS. 11(B-1) and 11(B-3) are enlarged views of regions enclosed by circles R shown in FIGS. 11(A-1) and 11(A-3), respectively. Further, FIG. 11(B-2) is an enlarged view corresponding to the "mating halfway state".

In FIG. 11, spring members 60 are shown. The spring members 60 shown in FIG. 11 are spring members 60 arranged at long sides of the mating portion formed in a rectangular shape when they are projected in the direction of the mating. These spring members 60 are firmly press-fitting into the inner housing 70. These spring members 60 are exposed from the inner housing 70 to project toward the second connector 2. On one hand, the housing 201 of the second connector 2 is provided with grooves 203 which the spring members 60 enter. These spring members 60 are plugged into the grooves 203 of the housing 201 of the second connector 2 which has come for mating in the direction of the mating. Thereby, when the spring members 60 are plugged into the grooves 203, they are deformed in a direction (in the left and right direction in FIG. 11) intersecting with the direction of the mating. It should be noted that the spring member 60 having a shape before being subjected to elastic deformation are illustrated. Therefore, in FIG. 11(B-3), the spring member 60 is illustrated in a state where it has bitten into a wall face of the groove 203. However, in fact, the spring member 60 is elastically deformed by being pressed onto the wall face of the groove 203.

FIG. 12 is cross-sectional views taken along line C-C in FIG. 9 and partially enlarged views. Here, FIGS. 12(A-1) and 12(A-3) show the "mating start state" and the "completely mating state", respectively, like FIGS. 11(A-1) and 11(A-3). Illustration of the "mating halfway state" is omitted to avoid complication in illustration. FIGS. 12(B-1) and 12(B-3) are enlarged views of regions enclosed by circles R shown in FIGS. 12(A-1) and 12(A-3), respectively. Further, FIG. 12(B-2) is an enlarged view corresponding to the "mating halfway state".

The spring members 60 are also shown in FIGS. 11(A-1), 11(A-3), 11(B-1), 11(B-2), 11(B-3), 12(A-1), 12(A-3), 12(B-1), 12(B-2), and 12(B-3). The spring members 60 are arranged at short sides of the mating portion formed in a rectangular shape when they are projected in the direction of the mating. These spring members 60 are firmly press-fitted into the inner housing 70. These spring members 60 are exposed from the inner housing 70 to project toward the second connector 2. On one hand, the housing 201 of the second connector 2 has grooves 203 which the spring members 60 enter. These spring members 60 are plugged into the grooves 203 of the housing 201 of the second connector 2 which has come for mating in the direction of the mating. Thereby, when the spring members 60 are plugged into the grooves 203, they are deformed in a direction (in the left and right direction in FIGS. 12(A-1), 12(A-3), 12(B-1), 12(B-2), and 12(B-3)) intersecting with the direction of the mating. It should be noted here that the spring members 60 have a shape before being subjected to elastic deformation are also illustrated like FIG. 11. Therefore, in FIGS. 12(B-2) and 12(B-3), the spring member 60 is illustrated in a state where it has bitten into a wall face of the groove 203. However, in fact, the spring member 60 is elastically deformed by being pressed onto the wall face of the groove 203.

A total of six members 60 are provided, as shown in FIG. 1. These spring members 60 have been press-fitted into the housing (the inner housing 70) of the first connector 1 and they enter the grooves 203 of the housing 201 of the second connector 2 in a state that they have been elastically deformed at the mating time. In this embodiment, rattling is prevented from occurring between the first connector 1 and the second connector 2 by these spring members 60 and grooves 203. The ratting prevention structure utilizing these spring members 60 and grooves 203 is mainly effective in rattling prevention in an in-plane direction intersecting with the mating direction. It should be noted that six spring members 60 are provided in this embodiment of the invention, but the number of spring members 60 is not limited to six. A different number of spring members 60 that are effective for rattling prevention can be provided.

Further, in this embodiment of the present invention, the spring members 60 are provided in both of the long sides and the short sides of the mating portion, but when the vibration direction is restricted, the spring members 60 may be provided, for example, in only the short side or only the long side, in order to prevent ratting in a direction corresponding to the vibration direction.

Further, in this embodiment of the present invention, the spring members 60 are arranged in the direction of the mating along the mating direction Z at positions behind the seal member 90, but they may be arranged at positions ahead of the seal member 90, for example at position F in FIG. 11.

A second embodiment of the present invention will now be described. It should be noted that only differences between the second embodiment and the first embodiment are illustrated and described. Further, same or common elements as those in the above-described first embodiment have the same reference numerals.

Figure 13:
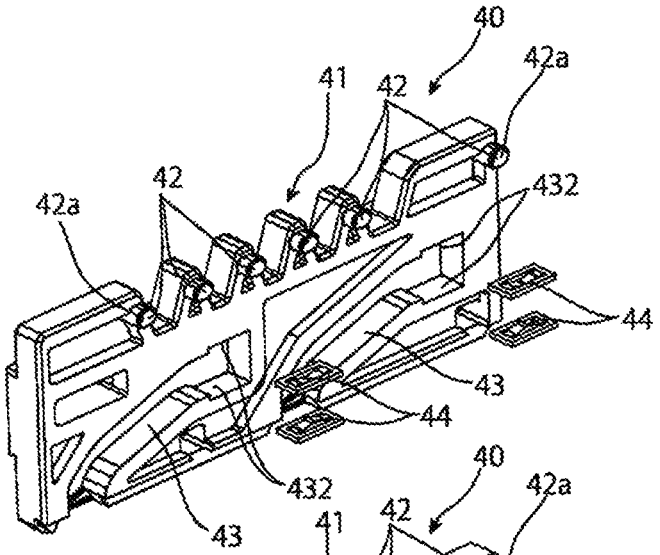
FIGS. 13(A), 13(B), and 13(C) are perspective views showing a cam member of a first connector according to a second embodiment of the present invention.
Figure 13:
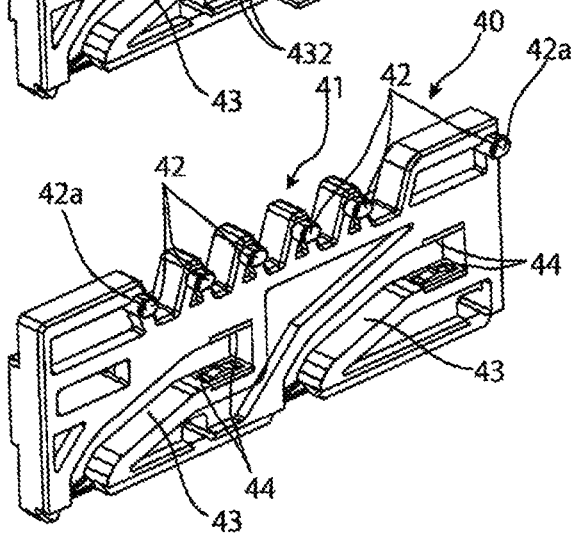
Figure 13:
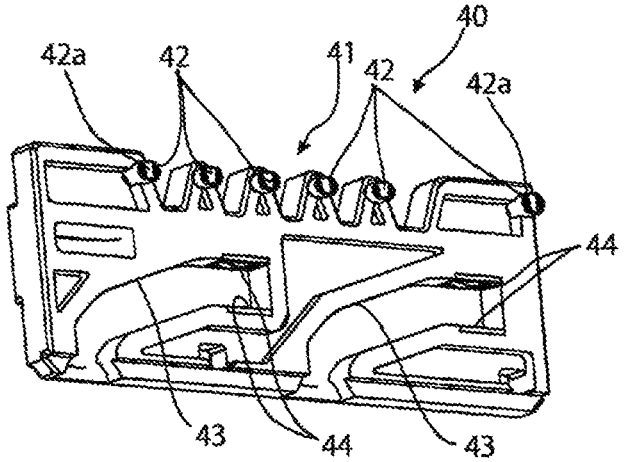

FIGS. 13(A), 13(B), and 13(C) are perspective views showing a cam member constituting a first connector in a second embodiment of the present invention. FIG. 13(A) is an exploded perspective view individually showing the spring members 44 which have been detached from the cam member 40. Further, FIGS. 13(B) and 13(C) are perspective views of the cam member 40 in a state where the spring members 44 have been attached to the cam member 40 as viewed at different angles.

Figure 4:
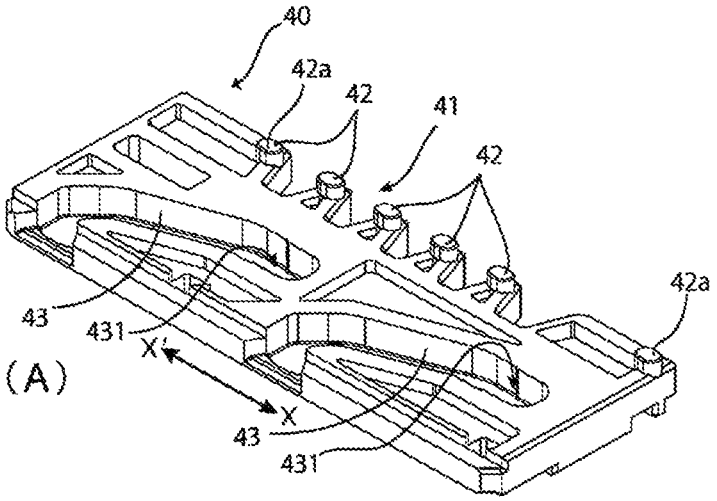
FIG. 4(A) is a perspective view of a cam member and FIG. 4(B) is a top view of a cam member.
Figure 4:
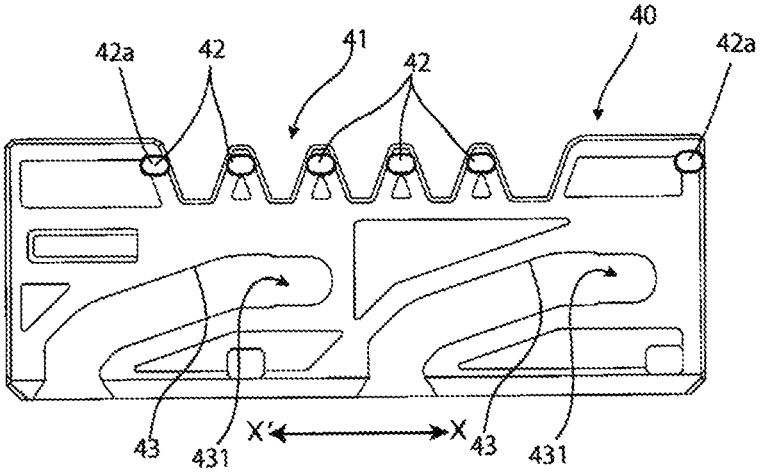

In the cam member 40 in the first embodiment shown in FIG. 4, the narrowing portions 431 where the groove width is narrowed are at the deepest portions of the cam grooves 43. On the other hand, a portion of the cam member 40 in the second embodiment, shown in FIG. 13, corresponding to the above-described narrowing portion 431 has spring arrangement portions 432 formed by expanding a groove width in a vertical direction. Two wedge-shaped spring members 44 are in the spring arrangement portions 432 so as to sandwich the cam groove 43 from the top and bottom.

Figure 14:
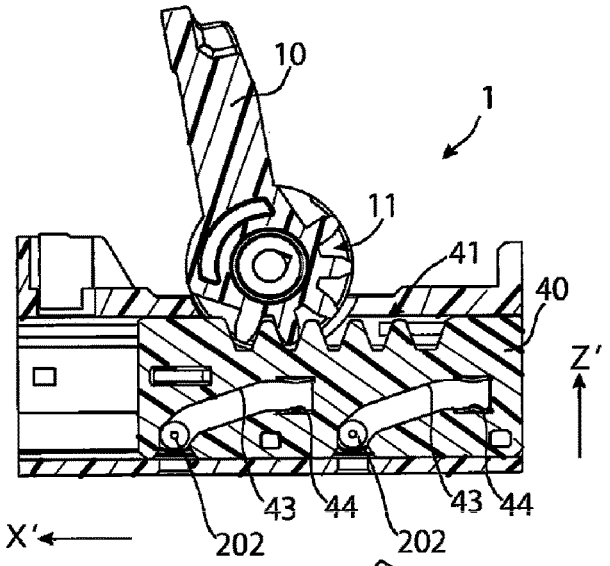
FIGS. 14(A), 14(B), and 14(C) are cross-sectional views taken along line D-D of FIG. 9(A) showing the connector assembly of FIG. 9(A) utilized as a connector assembly of the second embodiment of the present invention.
Figure 14:
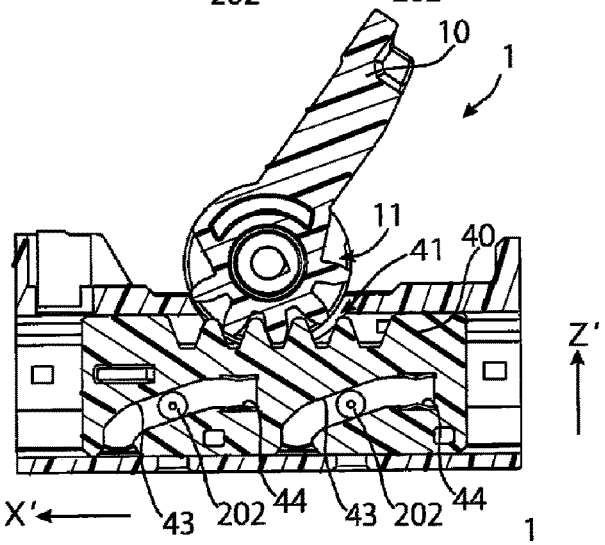
Figure 14:
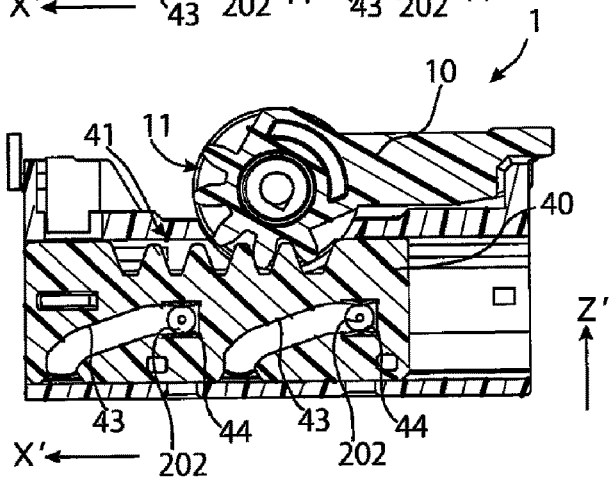

FIGS. 14(A), 14(B), and 14(C) are cross-sectional views of the connector assembly of the second embodiment of the present invention in which the connector assembly of the first embodiment is taken along line D-D of FIG. 9(A). The connector assembly shown in FIG. 9(A) is the connector assembly in the first embodiment, but both first embodiment and the second embodiment have the same appearance in a range expressed in FIG. 9(A). Therefore, FIG. 9(A) is here used for showing a portion in FIGS. 14(A), 14(B), and 14(C).

FIGS. 14(A), 14(B), and 14(C) of the second embodiment correspond to FIGS. 10(A), 10(B), and 10(C) of the first embodiment. FIGS. 14(A), 14(B), and 14(C) show the "mating start state", the "mating halfway state", and the "completely mating state", respectively.

In FIGS. 14(A), 14(B), and 14(C), the mating projections 202 provided on the housing 201 of the second connector 2 are shown (see also FIGS. 11(A-1), 11(A-3), 11(B-1), 11(B-2), 11(B-3), 12(A-1), 12(A-3), 12(B-1), 12(B-2), and 12) (B-3). The second connector 2 in the second embodiment is a connector having the same configuration as that of the second connector 2 in the first embodiment.

When the first connector 1 is put in the "mating start state" shown in FIG. 14(A), the second connector 2 is plugged into the first connector 1 until it reaches a temporarily engaged state. Thereby, as shown in FIG. 14(A), the mating projections 202 of the second connector 2 enter entrance portions of the cam grooves 43 of the cam member 40. Thereafter, advance to the "mating halfway state" and further the "completely mating state" occurs according to falling-down of the operation lever 10. At this time, the cam member 40 slides in the direction of arrow X' to draw the mating projections 202 in the direction of arrow Z'. When the mating projections 202 are drawn up to the deepest positions of the cam grooves 43, as shown in FIG. 14(C), the second connector 2 is put in a state where it has fully mated with the first connector 1.

The wedge-shaped spring members 44 are arranged above and below a portion where the mating projection 202 in the "completely mating state" is located. A distance between the upper and lower spring members 44 is such a width that the mating projection 202 is slightly press-fitted between the upper and lower spring members 44. Therefore, in the "completely mating state" shown in FIG. 14(C), the housing 201 of the second connector 2 is integrated with the cam member 40, so that a state where rattling is prevented from occurring therebetween is achieved.

Figure 15:
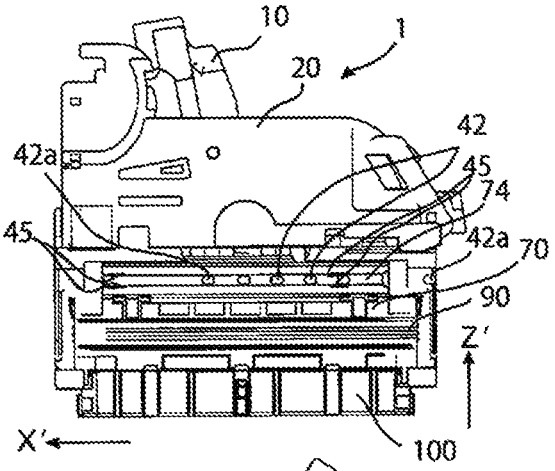
FIGS. 15(A), 15(B), and 15(C) are cross-sectional views of the first connector in the second embodiment of the present invention, taken along line B-B of FIG. 5(A)
Figure 15:
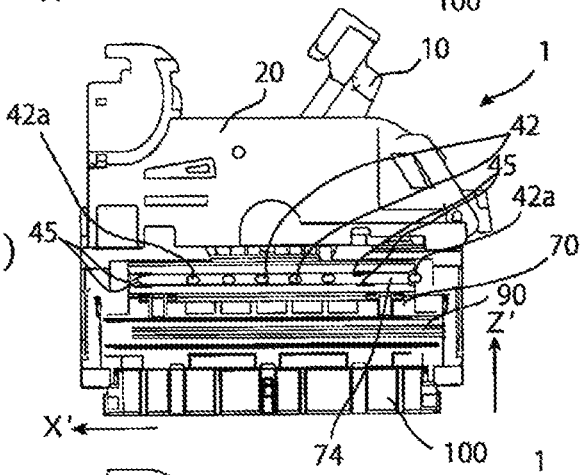
Figure 15:
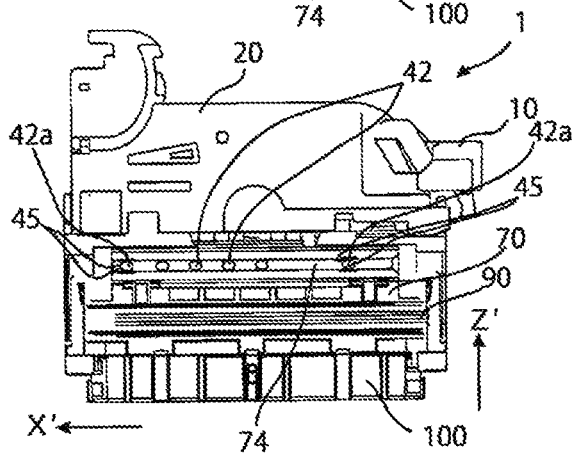

FIGS. 15(A), 15(B), and 15(C) are cross-sectional views of the first connector in the second embodiment of the present invention taken along line B-B of FIG. 5. FIGS. 15(A), 15(B), and 15(C) show the "mating start state", the "mating halfway state", and the "completely mating state", respectively Both the first connector in the first embodiment and the first connector in the second embodiment have the same appearance in a range expressed in FIG. 5 like FIG. 9. Therefore, FIG. 5 is used for showing a section portion in FIG. 15 as it is.

In FIG. 15, six bosses 42 on the cam member 40 are shown. These six bosses 42 move in the direction of arrow X' to advance to the "mating start state", the "mating halfway state", and further the "completely mating state". Here, wedge-shaped spring members 45 are at positions of the long groove 74 corresponding to two bosses 42*a* of six bosses 42 at both ends in the "completely mating state" shown in FIG. 15(C). These two bosses 42*a* at both ends are nipped by the spring members 45 in the "completely mating state".

Figure 16A:
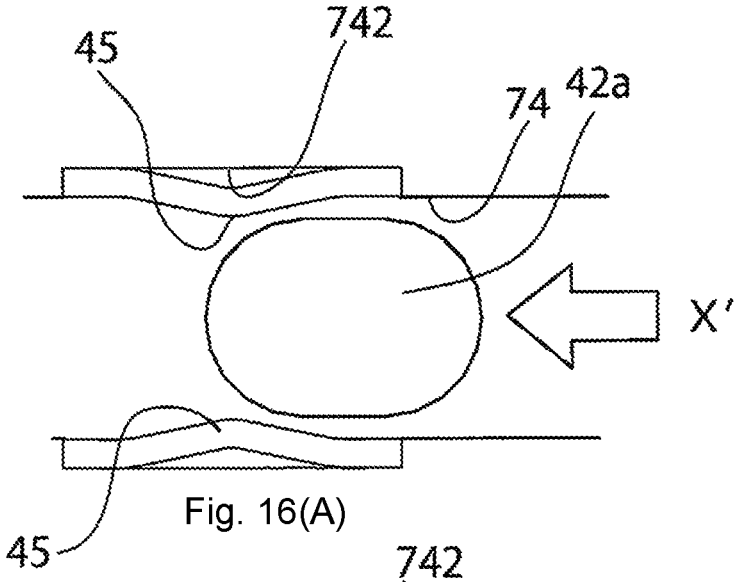
FIGS. 16(A) and 16(B) are schematic diagrams showing an aspect where a boss of a cam member is nipped by spring members.
Figure 16B:
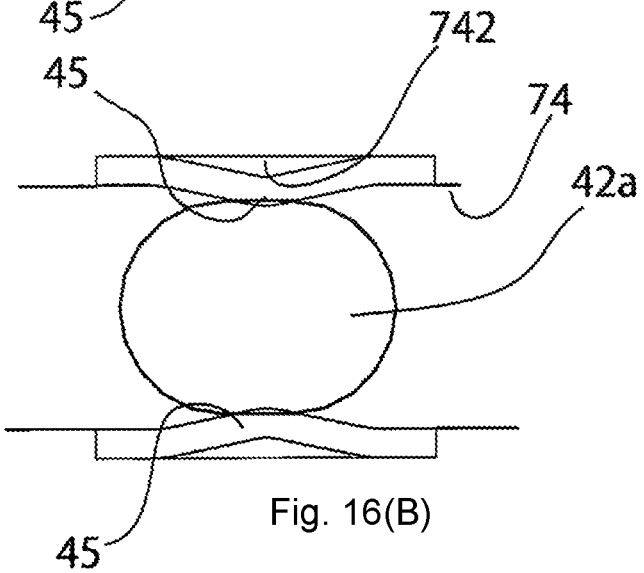

FIGS. 16(A) and 16(B) are schematic diagrams showing an aspect where a boss of a cam member is nipped by spring members. FIG. 16(A) shows a state where the boss 42*a* is located just before it is nipped by the spring members 45. FIG. 16(B) shows a state where the boss 42*a* has been nipped by the spring members 45.

Spring arrangement portions 742, where the groove width of the long groove 74 has been expanded, are at portions at which two bosses 42*a* at both the ends are located in the "completely mating state", respectively. The spring members 45 are in the spring arrangement portions 742. The spring members 45 are one example of the second spring member of the present invention.

The cam member 40 slides in the direction of arrow X' up to the "completely mating state". As shown in FIG. 16(B), two bosses 42*a* of the six bosses 42 at both ends on the cam member 40 are put in a state where they have been nipped by the upper and lower spring members 45 at the spring arrangement portions 742 of the long groove 74 in the inner housing 70. The distance between the upper and lower spring arrangement portions 45 is set at a distance in which the boss 42*a* is slightly press-fitted. When the bosses 42*a* are nipped by the spring members 45, the cam member 40 is integrated with the housing (the inner housing 70), so that it is in a state where rattling is prevented from occurring therebetween.

In the "completely mating state", the mating projections 202 are nipped by the spring members 44 in the cam groove 43 of the cam member 40, as explained with reference to FIGS. 14(A), 14(B), and (14(C). Therefore, in the "completely mating state", the first connector 1 and the second connector 2 are in an integrated state with each other via the cam member 40 by nipping of the mating projections 202 by the spring members 44 and nipping of the boss portion 42*a* by the spring members 45, so that rattling is prevented from occurring therebetween. The rattling preventing mechanism utilizing the cam member 40 is particularly effective in rattling prevention in the mating direction (the direction of arrow Z' or the direction of arrow Z in FIG. 1).

The structure of the bosses 42*a* of the six bosses 42 at both ends on the cam member 40 40 should be noted. However, the number of bosses to be nipped is not limited to two, and it may be one or three or more. However, when a plurality of bosses is nipped simultaneously, a large resistance to sliding of the cam member 40 may occur. Therefore, it is preferable that arrangement positions of the bosses or arrangement position of the narrowed portion or the spring member is set such that when the cam member 40 is located at a position except for the "completely mating state", the plurality of bosses are not nipped simultaneously.

Further, the long groove 74 extending in a lateral direction is in the inner housing 70 and the bosses 42 entering the long groove 74 are on the cam member 40, but this relationship may be reversed. That is, such a configuration that the long groove extending in a lateral direction is provided in the cam member 40 and the bosses entering the long groove are on the inner housing may be adopted. In this case, the configuration that the spring members corresponding to the spring members 45 shown in FIG. 15 and FIG. 16 are in the long groove on the cam member 40 and the bosses on the inner housing 70 are nipped by the spring members is adopted. This holds true for a case where the narrowing portion is in the long groove instead of the spring member.

Further, in the connector of the present invention, it is preferred that a second terminal portion of the guide groove at which the guide projection is located when the cam member slides to the mating completion position be formed to be narrower in width than a diameter of the guide projection and the second nipping portion nip the guide projection at the second terminal portion.

Thus, as the second nipping portion, a configuration where the second terminal portion of the guide groove is formed to be narrow in width and the guide projection is nipped at the second terminal portion can also be adopted. In this case, the second nipping portion can be configured without adding another member.

Further, in the connector of the present invention, a configuration where first spring members arranged so as to nip the cam pin are provided at the first terminal portion of the cam groove at which the cam pin is located when the cam member slides up to the mating completion position, and the first nipping portion nips the cam pin by the first spring members at the first terminal portion is also a preferable aspect.

Thus, such a structure that the first spring members are arranged at the first terminal portion of the cam groove and the cam pin is nipped by the first spring members can be adopted. This configuration is compared with a structure where the first terminal portion of the cam groove is made narrow in width and the cam pin is nipped directly at the first terminal portion made narrow in width. In the case of the structure where the cam pin is nipped directly at the first terminal portion having the narrow width, it is necessary to reduce the width of the first terminal portion of the cam groove or a tolerance of the diameter of the cam pin in order to keep the nipping force constant regardless of the connector. On the other hand, in the case of the configuration where the cam pin is nipped by the first spring members, a size error of the cam pin or the cam groove is cancelled by the first spring members, and even if a relatively large tolerance exists, a stable nipping of the cam pin is made possible. Further, in the connector of the present invention, a configuration where second spring members arranged so as to nip the guide projection is provided at the second terminal portion of the guide groove at which the guide projection are located when the cam member slides up to the mating completion position, and the second nipping portion nips the guide projection by the second spring members is also a preferable aspect.

The second nipping portion is also similar to the first nipping portion, and even if a relatively large tolerance exists, a stable nipping of the guide projection is made possible by nipping the guide projection by the second spring members.

What is claimed is:

1. A connector comprising:

a first housing having a mating portion configured to mate with a second housing which is a housing of a second connector;

a cam member having a cam groove configured to mate with a cam pin provided on the second housing, the cam member causing the second housing to mate with the first housing by sliding in a lateral direction intersecting with a direction of mating to draw the cam pin into the cam groove;

an operation lever sliding the cam member according to a turning operation; and a nipping portion nipping the cam pin in the cam groove when the cam member slides up to a mating completion position at which mating of the second housing with the first housing is completed.

2. The connector of claim 1, wherein a first terminal portion of the cam groove at which the cam pin is located when the cam member slides up to the mating completion position is formed so as to be narrower in width than a diameter of the cam pin, and the nipping portion nips the cam pin at the first terminal portion.

3. The connector of claim 2, wherein the cam groove is only narrower in width than a diameter of the cam pin at the first terminal portion.

4. The connector of claim 1, further comprising a plurality of spring members arranged so as to nip the cam pin at a first terminal portion of the cam groove at which the cam pin is located when the cam member slides up to the mating completion position, and the nipping portion nips the cam pin by the spring members at the first terminal portion.

5. The connector of claim 4, wherein the cam groove has a plurality of spring arrangement portions at the first terminal portion of the cam groove, the spring arrangement portions widening the cam groove in a vertical direction.

6. The connector of claim 5, wherein the spring members are arranged in the spring arrangement portions and are positioned opposite one another in the vertical direction about the first terminal portion of the cam groove.

7. The connector of claim 1, wherein the first housing has a guide groove extending in the lateral direction and the cam member has a guide projection entering the guide groove for guiding sliding of the cam member in the lateral direction.

8. The connector of claim 1, wherein the cam member has a guide groove extending in the lateral direction and the first housing has a guide projection entering the guide groove for guiding sliding of the cam member in the lateral direction.

9. A connector assembly comprising:

a first connector mating with a second connector along a mating direction, the first connector including:

a first housing having a mating portion configured to mate with a second housing of the second connector;

a cam member having a cam groove configured to mate with a cam pin provided on the second housing, the cam member causing the second housing to mate with the first housing by sliding in a lateral direction intersecting with a direction of mating to draw the cam pin into the cam groove;

an operation lever sliding the cam member according to a turning operation; and a nipping portion nipping the cam pin in the cam groove when the cam member slides up to a mating completion position at which mating of the second housing with the first housing is completed; and the second connector including the second housing and the cam pin provided on the second housing.

10. The connector assembly of claim 9, wherein a first terminal portion of the cam groove at which the cam pin is located when the cam member slides up to the mating completion position is formed so as to be narrower in width than a diameter of the cam pin, and the nipping portion nips the cam pin at the first terminal portion.

11. The connector assembly of claim 10, wherein the cam groove is only narrower in width than a diameter of the cam pin at the first terminal portion.

12. The connector assembly of claim 9, further comprising a plurality of spring members arranged so as to nip the cam pin at a first terminal portion of the cam groove at which the cam pin is located when the cam member slides up to the mating completion position, and the nipping portion nips the cam pin by the spring members at the first terminal portion.

13. The connector assembly of claim 12, wherein the cam groove has a plurality of spring arrangement portions at the first terminal portion of the cam groove, the spring arrangement portions widening the cam groove in a vertical direction.

14. The connector assembly of claim 13, wherein the spring members are arranged in the spring arrangement portions and are positioned opposite one another in the vertical direction about the first terminal portion of the cam groove.

15. The connector assembly of claim 9, wherein the first housing has a guide groove extending in the lateral direction and the cam member has a guide projection entering the guide groove for guiding sliding of the cam member in the lateral direction.

16. The connector assembly of claim 9, wherein the cam member has a guide groove extending in the lateral direction and the first housing has a guide projection entering the guide groove for guiding sliding of the cam member in the lateral direction.

* * * * *